US005775086A

United States Patent [19]

Stahlecker

[11] Patent Number: 5,775,086

[45] Date of Patent: Jul. 7, 1998

[54] DEVICE FOR OPENING FIBER MATERIAL INTO SINGLE FIBERS

[75] Inventor: Fritz Stahlecker, Josef-Neidhart-Strasse 18, 73337 Bad Überkingen, Germany

[73] Assignees: Fritz Stahlecker, Bad Uberkingen; Hans Stahlecker, Sussen, both of Germany

[21] Appl. No.: 802,351

[22] Filed: Feb. 11, 1997

[30] Foreign Application Priority Data

Mar. 7, 1996 [DE] Germany ..... 196 08 828.3

[51] Int. Cl.[6] ..... D01H 4/00

[52] U.S. Cl. ..... 57/408; 19/105; 19/112; 19/114; 57/411; 57/412

[58] Field of Search ..... 57/408, 411, 412; 19/112, 113, 114, 99, 105

[56] References Cited

U.S. PATENT DOCUMENTS

| | | | |
|---|---|---|---|
| 2,937,413 | 5/1960 | Hollingsworth | 19/114 |
| 3,064,316 | 11/1962 | Aoki | 19/105 |
| 3,136,005 | 6/1964 | Reiterer | 19/114 |
| 3,144,686 | 8/1964 | Aoki | 19/105 |
| 3,226,774 | 1/1966 | Reiterer | 19/99 |
| 4,392,276 | 7/1983 | Gauvain et al. | 19/112 X |
| 4,676,059 | 6/1987 | Artzt et al. | 57/408 X |
| 4,869,060 | 9/1989 | Stewart et al. | 57/408 X |
| 4,901,519 | 2/1990 | Wassenhoven et al. | 57/408 X |
| 4,937,919 | 7/1990 | Graf | 19/114 |
| 5,555,714 | 9/1996 | Mladek et al. | 57/408 |
| 5,566,541 | 10/1996 | Stahlecker et al. | 57/408 |

FOREIGN PATENT DOCUMENTS

| | | |
|---|---|---|
| 3823984A1 | 1/1990 | Germany . |
| 4040102A1 | 6/1992 | Germany . |

*Primary Examiner*—William Stryjewski

*Attorney, Agent, or Firm*—Evenson McKeown Edwards & Lenahan, PLLC

[57] ABSTRACT

An opening roller for an open-end spinning arrangement is provided on its periphery with suction openings and with a combing structure comprising teeth. Each tooth exhibits a tooth front facing the rotational direction, which tooth front forms a negative front angle relative to a radial plane extending through a tooth tip inclined backwards in the opposite direction to the rotational direction.

33 Claims, 4 Drawing Sheets

DEVICE FOR OPENING FIBER MATERIAL INTO SINGLE FIBERS

BACKGROUND AND SUMMARY OF THE INVENTION

The present invention relates to a device for opening fed slivershaped fiber material which forms a fiber beard downstream of a nipping point, into single fibers, and for transferring the single fibers to a transport device. An opening roller is provided which is driven to rotate and provided with suction openings and also combing teeth, each tooth thereof having in rotational direction a tooth front which forms a front angle with respect to a radial plane extending through the relevant tooth tip.

Devices of this type are disclosed in German published patent application 40 40 102 and U.S. Pat. No. 4,901,519 and are prior art. The known devices demonstrate the ability to draw the fiber beard extremely deep into the combing teeth by means of the effect of the suction openings, and thus to intensify the combing process. This provides the possibility, due to the improved combing effect, to operate at a lower speed of the opening roller than is usual. The known devices, however, do not take into account that with the presence of suction openings, the combing teeth should be adapted to the new given conditions, as otherwise difficulties occur in the transfer of the single fibers to a transport device.

It is an object of the present invention, while maintaining the favorable combing effect of the above mentioned prior art, to ensure in addition that transfer of the fibers to a transport device takes place without any difficulties.

This object has been achieved in accordance with the present invention in that the front angle of the combing teeth is inclined backwards in an opposite direction to the rotational direction.

It is usual in the case of opening rollers for open-end rotor spinning that the front angle of the teeth is inclined forward in rotational direction, that is, positive. The larger the positive front angle is, the more aggressive the combing teeth and more intensive the combing effect. As the suction openings draw the fiber beard deeper into the combing teeth up to the peripheral surface of the opening roller, a less aggressive combing teeth configuration is possible without the combing effect being lessened. The front angle can therefore be inclined in the opposite direction to the rotational direction, that is provide a so-called negative front angle, which facilitates the transfer of single fibers after the fiber material has been opened to a transport device arranged downstream. In the case of negative front angles, the single fibers have the tendency to leave the combing teeth quickly when they are no longer held by the suction openings.

In the case of opening rollers without suction openings, a relatively high rotational speed must be maintained, in order that combing is properly carried out at all. Only when the opening roller reaches a sufficiently high circumferential speed does the necessary air barrier layer form in the tooth grooves which ensures that the fiber beard is drawn into the combing means and laid down on the peripheral surface of the opening roller. The faster the opening roller runs, the better the fiber beard is sucked on by the effect of the air barrier layer and the better the combing and thus the opening of the fibers.

When suction openings are additionally present beside the tooth fitting, the circumferential speed of the opening roller can be significantly reduced without the combing effect deteriorating. There is no risk of the fiber beard not being properly placed into the combing means.

According to the invention it will be possible to keep the acceleration of the single fibers after they have been released from the fiber material so low so that a spinning process is possible in which the single fibers are never slowed down, but rather, in the ideal case, constantly accelerated. Only when the speed of the single fibers after release from the fiber beard is sufficiently low, is a yarn withdrawal speed achieved which is still controllable. The invention enables the opened single fibers to be transferred immediately, before they are accelerated too much, to a transport device arranged downstream.

As the combination of the combing teeth with the suction openings results in a good combing effect, despite the negative front angle, emphasis can be placed on the task of releasing the single fibers from the opening roller. The transfer of fibers to a transport device improves when the height of the tooth front measures a maximum of 2 mm, preferably approximately 1 mm. The suction openings should simply not have any effect any more after a certain transport distance. The negative front angle in combination with the low height of the tooth front ensure that the single fibers leave the combing teeth quickly.

While in the case of opening rollers used for rotor spinning, the combing teeth (fitting) extends as a rule in a helical shape, in a further embodiment of the present invention the combing fitting comprising the teeth extends exactly in rotational direction. Tooth mountings which are arranged parallel to the rotational direction have the advantage that the release of the single fibers to the transport device arranged downstream takes place with less disturbance than in the case of a helical tooth fitting, where during the transfer of the single fibers cross-overs can occur. The reduced combing effect is compensated for in that the fiber beard is forced to carry out a slight traversing motion.

The combing teeth fitting can be advantageously interspersed in rotational direction by tooth gaps. The free areas between the teeth lead to the fiber beard carrying out a small breathing movement. During such a breathing movement, the single fibers, which are not held fast anymore, can be released more easily from the fiber beard. It can be practical to arrange the suction openings preferably in the teeth gaps.

In order that the fiber beard is drawn into the tooth grooves, it is practical when the suction openings are each arranged in tooth grooves located between two adjacent rows of teeth. It is alternatively contemplated to arrange the suction openings in the lateral flanks of the teeth. As the lateral flanks contribute significantly to the combing effect, the releasing of the single fibers from the fiber material is also improved by this embodiment of the present invention.

It is practical when the edges of the suction openings are well rounded. Sharp-edged suction openings would not only lessen the suction effect, there would also be a risk that the single fibers would be cut and the fiber beard damaged.

In a particularly advantageous embodiment of the invention, the combing structure is arranged on an exchangeable mounting ring, which is cut from a solid block. In this way, the combing structure cannot only be exchanged when required, but due to the teeth being cut of a solid block, there is a wider choice with respect to tooth form. This applies in particular with respect to the angle of the lateral flanks of the teeth.

In the case of a spinning process whereby the single fibers are continuously accelerated, it is necessary that the single fibers are laid down on the transport devices in the form of a fiber veil expanded transversely to the rotational direction, the fiber veil already containing as many single fibers as are required in the subsequent yarn. In order that an open end arises when spinning of the single fibers to a yarn begins, the fiber veil must have a minimum width. For forming a laterally open fiber formation, it is therefore practical when the width of the combing structure measures at least 70 mm.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
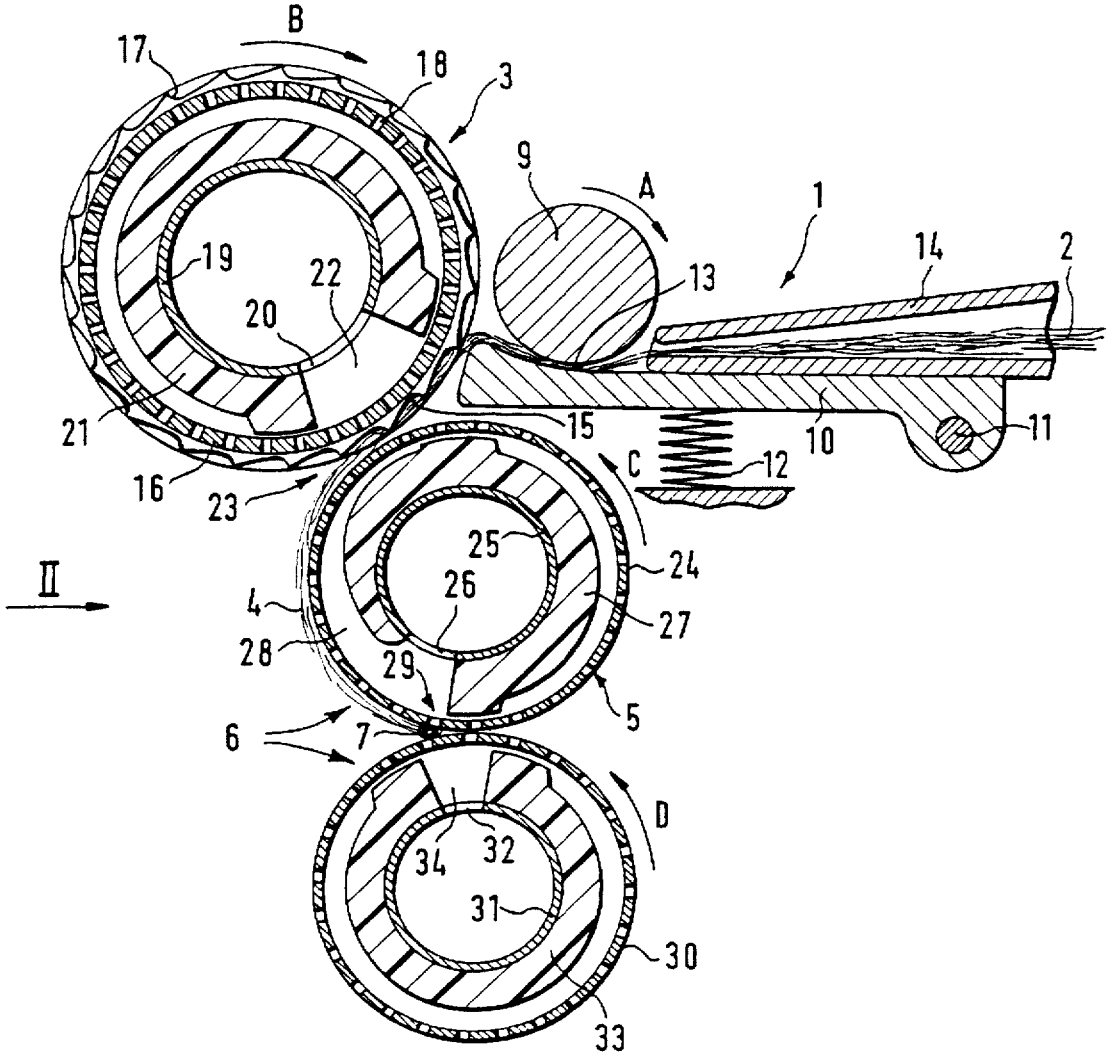
FIG. 1 is a sectional schematic side view of a device constructed according to a preferred embodiment of the present invention.
Figure 2:
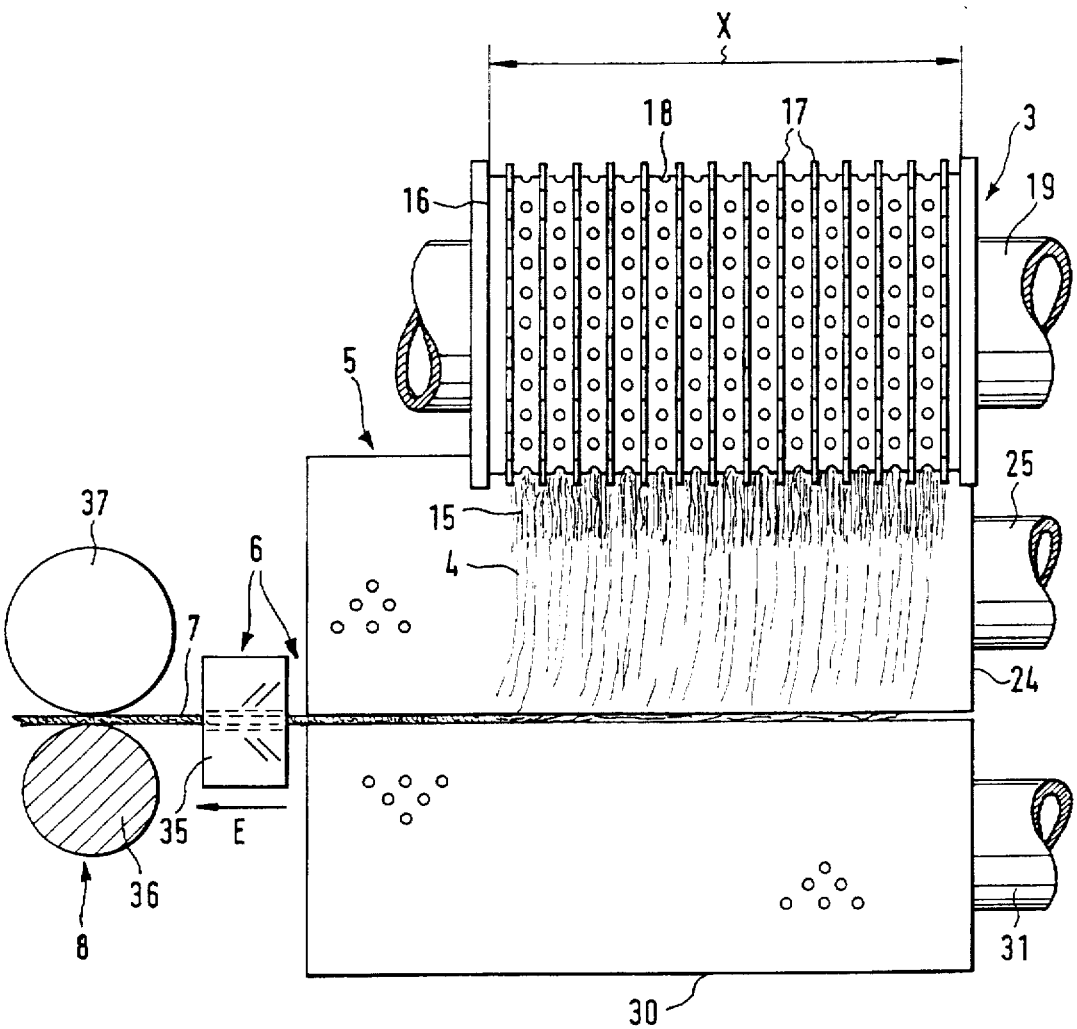
FIG. 2 is a schematic view taken in the direction of the arrow II of FIG. 1.

The open-end spinning aggregate according to FIGS. 1 and 2 comprises a feeding device 1 for fiber material 2, which fiber material can consist of a wide sliver or a plurality of adjacently fed slivers. The spinning aggregate includes device 3 for opening the fiber material 2 to single fibers 4, a transport device 5 which will be described below in more detail, a twist device 6 for spinning the single fibers 4 to a yarn 7 and a yarn withdrawal device 8 for withdrawing the spun yarn 7 and delivering it to a winding device (not shown).

The feeding device 1 comprises a feed roller 9 driven in rotational direction A, whose width corresponds to the width of the sliver-shaped fed fiber material 2. A feed table 10 operates in conjunction with the feed roller 9, which feed table 10 can be swivelled around a swivel axle 11 and which is pressed by a weighted spring 12 against the feed roller 9, with which it forms a nipping point 13 which nips the fiber material 2. A feed condenser 14 for the fiber material 2 is arranged upstream of the feed roller 9.

Downstream of the nipping point 13, the feeding device 1 presents the fiber material 2 in the form of a fiber beard 15 to the opening device 3. This comprises an opening roller 16 which runs in rotational direction B, that is, in the same rotational direction as the feed roller 9; the circumferential speed of the opening roller 16 being many times that of the circumferential speed of the feed roller 9. The opening roller 16 is provided on its periphery with a combing structure 17, which can be arranged extending either helically in the usual way or parallel to the rotational direction B. In the latter case, it is practical when the feed table 10 is constructed to traverse very slightly. A combing structure 17 arranged parallel to the rotational direction B, as for example shown in FIG. 2, has the advantage that the single fibers 4 can leave the combing structure 17 more easily after being released from the fiber beard 15.

The circumference of the opening roller 16 is provided further with suction openings 18, which suck the fiber beard 15 deep into the combing structure 17 and thus intensify the combing effect. The effective width X of the opening roller 16 corresponds at least to the width of the fed fiber material 2.

The opening roller 16 is supported on a suction tube 19, which is provided in the area of the fiber beard 15 with a suction slit 20. The suction tube 19 supports an adjustable suction insert 21, which continues the suction slit 20 and defines a suction area 22, in which the suction openings 18 are effective. The remaining peripheral area of the opening roller 16 is kept ineffective by the suction insert 21.

The suction area 22, directed against the fiber beard 15, extends approximately from the height of the feed table 10 through an angle of approximately 45° to an area 23 at which the transfer of the single fibers 4, which have been separated from the fiber beard 15, to the transport device 5 takes place.

The transport device 5 takes the form of a suction roller 24, as known in friction spinning. The suction roller 24 is also provided on its periphery with suction openings and has an effective width which is broader in yarn withdrawal direction than the effective width X of the opening roller 16. The enlarged effective width of the suction roller 24 serves to improve the twist on the yarn 7 to be spun.

The suction roller 24, driven in rotational direction C, in opposite direction to the opening roller 16 but at a somewhat higher rotational speed, is supported on a suction tube 25, which comprises a suction slit 26. A suction insert 27 is slid onto the suction tube 25, which suction insert 27 extends the suction slit 26 through a suction area 28, which extends from the area 23 of the transfer of the single fibers 4 to the suction roller 24 up to a yarn formation line 29, which extends transversely to rotational direction C. The single fibers 4 are spun into the yarn 7 in the fiber formation line 29 and withdrawn by the yarn withdrawal device 8 transversely to the rotational direction C at a speed which is somewhat faster than the circumferential speed of the suction roller 24.

Twist for the yarn 7 is imparted with the aid of a friction roller 30, which rotates in rotational direction D and thus in the same rotational direction as the suction roller 24. This friction roller 30 is also in the form of a suction roller comprising perforations at its periphery, and lies in close proximity to the suction roller 24, so that the wedge-shaped gap for the yarn formation line 29 is formed between the suction roller 24 and the friction roller 30. The yarn 7 obtains here a certain pre-twist, which is then completed by an air nozzle 35 located downstream. The twist device 6 is thus on the one hand formed by the suction roller 24 in connection with the friction roller 30 and on the other hand by the air nozzle 35.

The friction roller 30 is supported on a suction tube 31, which is provided with a suction slit 32 directed against the wedgeshaped gap. The suction area 34 is here also defined by a suction insert 33 arranged on the suction tube 31.

The yarn withdrawal device 8, located downstream from the air nozzle 35 in withdrawal direction E, comprises a driven driving cylinder 36, whose circumferential speed is somewhat faster than the circumferential speed of the suction roller 24. A pressure roller 37 is disposed on the driven cylinder 36 and flexibly pressed thereon.

The described open-end spinning aggregate works according to a spinning process whereby the single fibers 4, starting from the feeding of the fiber material 2 and ending with the finished yarn 7, are at no point slowed down, but are ideally continuously accelerated. Because of this continuously increased speed for the single fibers 4, a withdrawal speed for the yarn withdrawal device 8 could arise which, in its order of magnitude, was no longer controllable. For this reason, the single fibers 4 are not to be accelerated too fast by the device 3 for opening the fiber material 2. This is made possible by the suction openings 18 in connection with the embodiment of the combing structure 17, which will be described in more detail below, whereby the circumferential speed of the opening roller 16 can be significantly lower than has been the case up to now.

Furthermore, the transport device 5 takes up the single fibers 4 released from the fiber material 2 as soon as they have left the fiber beard 15. Despite the already very low acceleration of the single fiber 4 by the opening roller 16, the single fibers 4 are transported further at a controlled speed, which is only slightly higher than the speed of the single fibers 4 as they arrive at the suction roller 24. The single fibers 4 are disposed on the suction roller 24 in the form of a fiber veil extending transversely to the rotational direction C, the width of the fiber veil being to such an extent that the single fibers 4 have scarcely any lateral contact with one another. This is a so-called lateral open fiber formation, whereby it is also possible to generate an open end for the spinning process. This lateral open fiber formation, which is transported by the suction roller 24 to the fiber formation line 29, comprises already at least as many single fibers 4 as required later for the cross section of the yarn 7 to be spun. In order that the number of single fibers 4 is possible, the sliver-shaped fed fiber material 2 consists of a very wide sliver or, as desired, of a plurality of adjacently arranged slivers.

Due to the fiber veil being extended transversely to the rotational direction C, the single fibers 4 arrive at the fiber formation line 29 axially staggered. This axial staggering lessens any drafting faults which may have occurred during opening of the fiber material 2. The staggering leads unavoidably to a somewhat tighter twist in the center of the yarn 7 and to a looser twist on the outside of the yarn 7. This division of the degree of twist can, however, be predetermined by the width of the fiber material 2 fed into the spinning device.

The circumferential speed of the opening roller 16 should be significantly lower than was known for example in rotor spinning. Circumferential speeds of only approximately 10 m/s should be aimed for, which are made possible by the suction openings 18 in connection with the particular embodiment of the combing structure 17 which will be described below. The fiber beard 15 is drawn deep into the combing structure 17 in the case of such an opening roller 16 and opened efficiently, while the single fibers 4 can easily leave the opening roller 16 at the point 23 of transferral to the transport means 5.

Tests have shown that opening rollers 16 provided with suction openings 18 clearly improve the evenness of the spun yarn 7. The suction behavior of the fiber beard 15 is more intensive at reduced circumferential speeds of the opening roller 16 and with a greater number of suction openings 18.

A vacuum of approximately 350 mm water-column pressure is sufficient at a rotation of the opening roller 16 of approximately 3,000 rpm. The suction area 22 should extend over a length of 15 mm.

The vacuum of the suction roller 24 must be clearly higher than the vacuum in the inside of the opening roller 16, so that the single fibers 4 are transferred properly from the opening roller 16 to the transport means 5. Approximately 1000 mm water-column pressure are necessary for the suction roller 24, with a maximum suction effect in the area of the fiber formation line 29. The opening roller 16 uses approximately one third of the required air and the suction roller 24 approximately two thirds.

Figure 3:
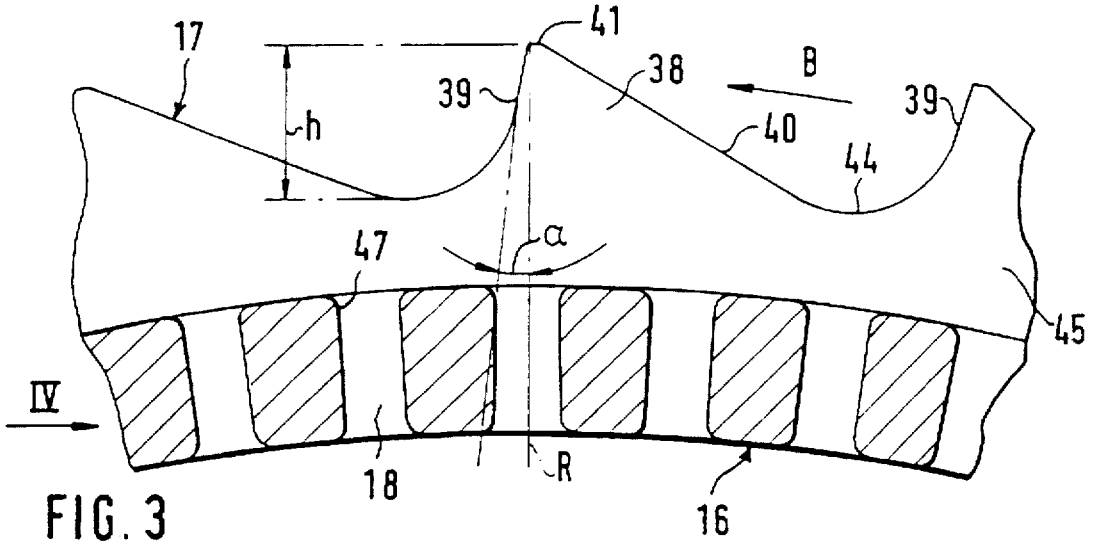
FIG. 3 is a greatly enlarged partial section cut through the combing structure of the opening roller according to FIG. 1.

In the following, the particular form of the teeth 38 will be described with the aid of the greatly enlarged combing structure 17 shown in FIGS. 3 and 4. The individual teeth 38 are arranged one behind the other either in rotational direction B or in a slight helical shape, and in a plurality of adjacently arranged rows 46 of teeth. This is known principally from the standard opening rollers, whereby however, in accordance with the present invention, the form of the combing structure 17 is different.

Each of the teeth 38 comprises in rotational direction B a tooth front 39, which extends from a tooth base 44 to a tooth tip 41. The tooth front 39 begins at the tooth base 44 with a definite curve and then extends approximately lineal to the tooth tip 41. The connection to the next tooth is formed by the so-called tooth back 40. As can be seen in particular from FIG. 4, the individual teeth 38 have lateral flanks 42 and 43, which taper towards each other in the direction of the tooth tip 41. The lateral flanks 42 and 43 are extended underneath the tooth base 44, so that tooth grooves 45 are formed between two adjacent tooth rows 46.

Distinguishing the combing structure 17, in particular for the use of opening rollers 16 with suction openings 18, is the front angle $\alpha$, which the tooth front 39 forms with a radial plane R extending through the tooth tip 41. Deviating from the standard opening rollers, the front angle $\alpha$ of the opening roller 16 of the present invention, which is provided with suction openings 18 is negative, which by definition means that the front angle $\alpha$ is inclined backwards in the opposite direction to the rotational direction B. Thus, the tooth front 39—starting from the tooth base 44 and ending at the tooth tip 41—remains somewhat behind the radial plane R with respect to the rotational direction B. The negative front angle $\alpha$ can measure between 2° and 8° and preferably about 6°.

Negative front angles $\alpha$ have the tendency that the single fibers 4 transported by the opening roller 16 are not held for very long in the combing structure 17, but rather try to leave the teeth 38. In the case of opening rollers without suction openings 18, the single fibers 4 are transported first and foremost by the friction on the lateral flanks 42 and 43 and are thereby continuously accelerated. In order that the single fibers 4 remain in the combing structure in standard opening rollers, the front angle should be positive.

In the case of the opening roller 16 according to the present invention, the suction openings 18 ensure that, despite the negative front angle $\alpha$, the single fibers 4 are sufficiently drawn into the tooth grooves 45. However, as soon as the end of the suction area 22 is reached, that is as soon as the suction openings 18 are not sucked from the inside any longer, the negative front angle $\alpha$ ensures that the single fibers 4 leave the combing structure 17 immediately and can be transferred to the transport device 5. The negative front angle $\alpha$ is thus not disadvantageous for the combing effect, due to the presence of the suction openings 18.

The suction openings 18 permit the height h of the tooth front 39 to be lower than is usual. The reduced height h of the teeth 38 also aids the release of the single fibers 4 from the combing structure 17 as soon as the area 23 for transferring them to the transport device 5 has been reached.

Figure 4:
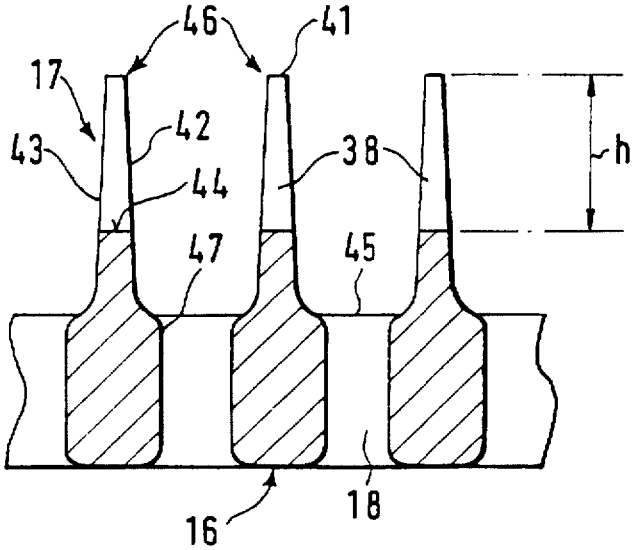
FIG. 4 is a view in the direction of the arrow IV of FIG. 3.

As can be seen in particular from FIG. 4, the suction openings 18 are each arranged in the tooth grooves 45 between the two teeth rows 46. The edges 47 of the suction openings 18 should be well rounded. If the suction openings 18 had sharp edges at their tops and ends, this would not only drastically reduce the suction effect, there would also be a risk that too much fly would be generated. As long as the single fibers 4 are still held at the nipping point 13, the suction openings 18 glide past the fiber beard 15. With sharp edges, there would be a risk that pieces of the single fibers 4 would be cut off and the fiber beard 15 damaged.

Figure 5:
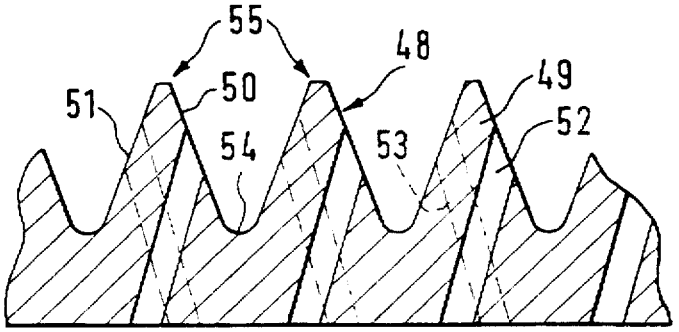
FIG. 5 is a view similar to FIG. 4 of another embodiment of the combing structure.

Differing from the embodiment described above, FIG. 5 shows a greatly enlarged combing structure 48, in which V-shaped tooth grooves 54 are formed. The lateral flanks 50 and 51 of the teeth 49 forming the tooth rows 55 have, in comparison to FIG. 4, a relatively large angle of inclination. In the case of this combing structure 48, suction openings 52 and 53 are provided, which do not run into the tooth grooves 54, but rather into the lateral flanks 50 and 51. This means that a suction opening 52 runs into the right lateral flank 50 of a tooth 49 and the following suction opening 53 runs into the left lateral flank 51 of the subsequent tooth. By means of these measures, the single fibers 4 are disposed more on the lateral flanks 50 and 51 and less on the tooth grooves 54. This also improves the combing effect, so that the opening roller can operate at a greatly reduced circumferential speed. In the embodiment in FIG. 5, there is also a negative front angle $\alpha$.

Figure 6:
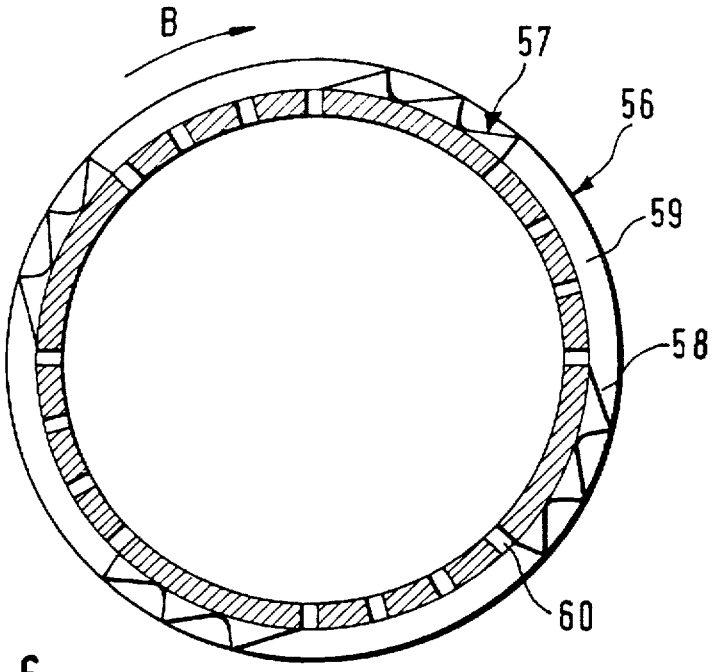
FIG. 6 is a partial view similar to a part of FIG. 1, showing a different embodiment of an opening roller.

Differing from the embodiments described above, FIG. 6 shows an opening roller 56 whereby the combing structure 57 is periodically interspersed—in rotational direction B—by tooth gaps 59. The teeth are thus arranged as teeth segments 58, whereby the suction openings 60 are preferably located in the areas of the tooth gaps 59. The suction openings 60 can alternatively be divided over the entire periphery of the opening roller 56.

Teeth segments 58 of the combing structure 57 are arranged in such a way in connection with the tooth gaps 59 to enable the fiber beard 15 to carry out short breathing movements. The single fibers 4 no longer held in the nipping point 13 4 are thus better able to be pulled out of the fiber beard 15. This results in a more intensive separation of the fiber material 2 into single fibers 4. The suction openings 60 in the tooth gaps 59 pull the fiber beard 15 securely onto the periphery of the opening roller 56, so that the following tooth segments 58 can enter the fiber beard 15 as effectively as possible and comb it. It is hereby practical when the tooth gaps are well rounded.

Figure 7:
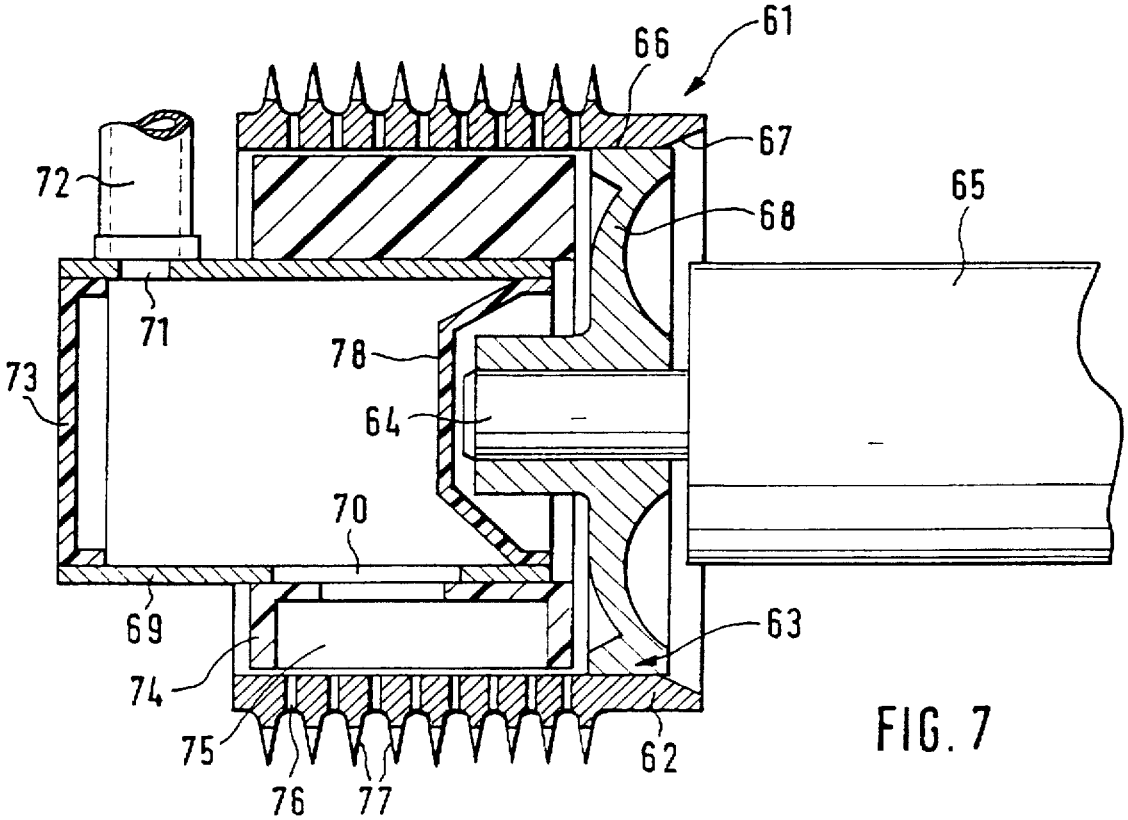
FIG. 7 is a sectional schematic view of an opening roller similar to FIG. 2, wherein the combing structure is arranged on an exchangeable combing ring with combing teeth.

In the embodiment according to FIG. 7, the opening roller 61 comprises a ring 62 with combing structure, which is exchangeable and whereby the combing structure is cut from a solid block. This type of combing ring is known in the industry as a "solid ring".

The ring 62 with combing structure in FIG. 7 is relatively thin-walled and is pressed onto a base body 63 of the opening roller 61. The base body 63 rests in turn in a non-rotatable way on a shaft 64, which is supported in a bearing housing 65 (indicated only). On the side of the bearing housing 65 facing away from the opening roller 61, the shaft 64 projects outwards with a drive wharve (not shown) which is driven by a drive belt.

The base body 63 is provided on its outer circumference with a ground centering surface 66, onto which the ring 62 with combing structure is slid with press fit during assembly. The ring 62 with combing structure has for this purpose a slope 67. The base body 63 itself has a somewhat flexible back wall 68, which facilitates assembly.

Visible is the suction tube 69, located in the inside of the opening roller 61 and comprising a suction slit 70. The suction tube 69 is connected to a vacuum conduct 72 through a transverse bore hole 71. The suction tube 69 is sealed at both ends by a sealing plug 73 and 78. The suction tube 69 supports a suction insert 74, which defines a suction area 75 as described above, which corresponds to the suction area 22 of FIG. 1. The suction openings 76 of the ring 62 with combing means are located between two rows of teeth 77.

In the case of the ring 62 with combing structure in FIG. 7, the individual teeth 77 also show a negative front angle $\alpha$ (not shown here).

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. An opening roller for an open-end spinning aggregate for opening at least one sliver to single fibers at an opening area and for transporting the single fibers to a transfer area which is adjacent the opening area and where the fibers are transferred in the form of a fiber veil to a transport device, comprising:

a rotatable combing ring having an effective width corresponding to at least a width of the fiber veil, a periphery of said combing ring comprising suction openings as well as combing teeth, each combing tooth having a tooth front in a rotational direction which tooth front forms a front angle relative to a radial plane extending through a radial tip of the respective tooth, said front angle being inclined backwards in a direction opposite to the rotational direction, a vacuum device for sucking air through the suction openings into the interior of the opening roller, and an insert in said opening roller which in use defines a suction area extending in an opening roller rotational direction from the opening area to the transfer area while rendering the suction ineffective over remaining peripheral areas of the opening roller.

2. An opening roller according to claim 1, wherein the height of the respective tooth fronts measure a maximum of 2 mm.

3. An opening roller according to claim 2, wherein the combing teeth extend in circumferential rows parallel to a rotational direction of the opening roller.

4. A opening roller according to claim 3, wherein the combing teeth are interspersed in the rotational direction by tooth gaps.

5. An opening roller according to claim 4, wherein the suction openings are arranged in tooth gaps between respective ones of said teeth.

6. An opening roller according to claim 3, wherein the suction openings are each arranged in tooth grooves located between two rows of teeth.

7. An opening roller according to claim 3, wherein the suction openings are arranged in lateral flanks of the teeth.

8. An opening roller according to claim 3, wherein the edges of the suction openings are well rounded.

9. An opening roller according to claim 3, wherein the combing teeth are arranged on an exchangeable combing ring.

10. An opening roller according to claim 9, wherein the combing teeth are cut from a solid block.

11. An opening roller according to claim 3, wherein the effective width of the combing teeth in a direction parallel to an opening roller axis measures at least 70 mm.

12. An opening roller according to claim 2, wherein the combing teeth are interspersed in the rotational direction by tooth gaps.

13. An opening roller according to claim 5, wherein the suction openings are arranged in tooth gaps between respective ones of said teeth.

14. An opening roller according to claim 1, wherein the combing teeth extend in circumferential rows parallel to a rotational direction of the opening roller.

15. An opening roller according to claim 1, wherein the combing teeth are interspersed in the rotational direction by tooth gaps.

16. An opening roller according to claim 15, wherein the suction openings are arranged in tooth gaps between respective ones of said teeth.

17. An opening roller according to claim 16, wherein the suction openings are each arranged in tooth grooves located between two rows of teeth.

18. An opening roller according to claim 15, wherein the suction openings are arranged in lateral flanks of the teeth.

19. An opening roller according to claim 15, wherein the combing teeth are arranged on an exchangeable combing ring.

20. An opening roller according to claim 15, wherein the combing teeth are cut from a solid block.

21. An opening roller according to claim 1, wherein the suction openings are each arranged in tooth grooves located between two rows of teeth.

22. An opening roller according to claim 1, wherein the suction openings are arranged in lateral flanks of the teeth.

23. An opening roller according to claim 1, wherein the edges of the suction openings are well rounded.

24. An opening roller according to claim 1, wherein the combing teeth are arranged on an exchangeable combing ring.

25. An opening roller according to claim 1, wherein the combing teeth are cut from a solid block.

26. An opening roller according to claim 1, wherein the effective width of the combing teeth in a direction parallel to an opening roller axis measures at least 70 mm.

27. Open end spinning apparatus comprising:

a fiber feeding device, and an opening roller operative to open sliver from the sliver feeding device to single fibers at an opening area and for transporting the single fibers in the form of a fiber veil to a transport device, and a twist applying device which in use applies a twist to said veil to form a yarn at a yarn formation line, wherein said opening roller comprises:

a rotatable combing ring having an effective width corresponding to at least a width of the fiber veil, a periphery of said combing ring comprising suction openings as well as combing teeth, each combing tooth having a tooth front in a rotational direction which tooth front forms a front angle relative to a radial plane extending through a radial tip of the respective tooth, said front angle being inclined backwards in a direction opposite to the rotational direction, a vacuum device for sucking air through the suction openings into the interior of the opening roller, and an insert in said opening roller which in use defines a suction area extending in an opening roller rotational direction from the opening area to the transfer area while rendering the suction ineffective over remaining peripheral areas of the opening roller.

28. Open end spinning apparatus according to claim 27, further comprising a transport device in the form of a suctioned transport roller disposed adjacent the opening roller and operating to transport said fiber veil to the yarn formation line on the transport roller surface.

29. Open end spinning apparatus according to claim 28, wherein the twist applying device in use supplies fiber veil twisting forces to said fiber veil at said yarn formation line.

30. Open end spinning apparatus according to claim 29, wherein said twist applying device is a suctioned roller.

31. A method of open end spinning comprising:

providing the opening roller with an opening roller surface, feeding sliver to said opening roller surface, opening the sliver on the opening roller at an opening area and transporting the single fibers to a transfer area adjacent the opening area by way of the opening roller with the fibers being transferred in the form of a fiber veil to a transport device, and applying a twist to said veil to form a yarn at a yarn formation line on said transport device, wherein said opening roller comprises:

a rotatable combing ring having an effective width corresponding to at least a width of the fiber veil, a periphery of said combing ring comprising suction openings as well as combing teeth, each combing tooth having a tooth front in a rotational direction which tooth front forms a front angle relative to a radial plane extending through a radial tip of the respective tooth, said front angle being inclined backwards in a direction opposite to the rotational direction, a vacuum device for sucking air through the suction openings into the interior of the opening roller, and an insert in said opening roller which in use defines a suction area extending in an opening roller rotational direction from the opening area to the transfer area while rendering the suction ineffective over remaining peripheral areas of the opening roller.

32. A method according to claim 31, comprising transporting the fiber veil from the transfer area to the yarn formation line on a suction transport roller disposed adjacent the opening roller.

33. A method according to claim 32, wherein said applying a twist is performed by a suction roller disposed adjacent to and parallel to the transport roller.

* * * * *